US005279012A

United States Patent [19]

Sloan

[11] Patent Number: 5,279,012

[45] Date of Patent: Jan. 18, 1994

[54] SELF-PROPELLED STEERABLE APPARATUS FOR REMOVING MATERIAL FROM SURFACE OF CONFINED AREA

[75] Inventor: Albert H. Sloan, Ft. Lauderdale, Fla.

[73] Assignee: Subaqueous Services, Inc., Fort Lauderdale, Fla.

[21] Appl. No.: 895,795

[22] Filed: Jun. 9, 1992

[51] Int. Cl.[5] ..... B08B 9/08

[52] U.S. Cl. ..... 15/1.7; 15/3; 15/319; 15/246.5; 414/310

[58] Field of Search ..... 15/3, 117, 4, 246.5, 15/56, 319; 37/257, 259, 248, 249, 251, 223, 244, 66, 77; 299/39, 64, 65; 414/306, 308, 310, 312, 304

[56] References Cited

U.S. PATENT DOCUMENTS

| | | | |
|---|---|---|---|
| 1,482,524 | 2/1924 | Robinson | 414/308 |
| 2,587,415 | 2/1952 | Vanvick | 37/257 |
| 2,816,804 | 12/1957 | Harrer | 37/251 |
| 3,337,889 | 8/1967 | West | 15/1.7 |
| 3,412,862 | 11/1968 | Chaplin | 15/1.7 |
| 3,859,948 | 1/1975 | Romano et al. | 15/1.7 |
| 4,574,501 | 3/1986 | Sloan | 37/58 |
| 4,701,093 | 10/1987 | Meyer | 414/312 |
| 4,979,322 | 12/1990 | Sloan | 37/65 |
| 5,093,959 | 3/1992 | Sloan | 15/1.7 |
| 5,138,741 | 8/1992 | Allen | 15/3 |

FOREIGN PATENT DOCUMENTS

| | | | |
|---|---|---|---|
| 0565960 | 7/1960 | Belgium | 37/251 |
| 1256579 | 2/1961 | France | 414/310 |
| 2652103 | 3/1991 | France | 37/257 |

*Primary Examiner*—Harvey G. Hornsby
*Assistant Examiner*—Gary K. Graham
*Attorney, Agent, or Firm*—Nilles & Nilles

[57] ABSTRACT

Self-propelled steerable apparatus for removing material, such as sludge, from the bottom surface of a liquid storage tank for disposition elsewhere comprises a support platform and a reversely rotatable motor-driven auger mounted below the support platform and cooperating therewith to define a space for receiving sludge when the rotatable auger is engaged with the surface. A motor-driven pump mounted on the support platform is operable to receive sludge from the auger and deliver it through a discharge hose to a remote location. Rotation of the auger delivers the sludge to the pump and propels the apparatus across the surface. A remotely controllable steering mechanism on the support platform has a tail wheel which engages the surface and steers the apparatus along a desired path. A winch-controlled back-haul cable is connected to the apparatus to periodically stop forward movement of the apparatus while the auger is still rotating so that the sludge can be more efficiently removed.

19 Claims, 9 Drawing Sheets

SELF-PROPELLED STEERABLE APPARATUS FOR REMOVING MATERIAL FROM SURFACE OF CONFINED AREA

BACKGROUND OF THE INVENTION

1. Field of Use

This invention relates generally to self-propelled steerable apparatus for removing material from the surface of a confined area and for pumping it to another location for disposition.

In particular, it relates to such apparatus which is especially well-adapted, for example, to clean sludge from the bottom of large liquid storage tanks, such as chemical or oil tanks, but could have other applications, such as cleaning any container or confined area having a solid rigid bottom or floor made of metal, concrete, plastic or the like.

2. Description of the Prior Art

My U.S. Pat. No. 5,093,949, issued Mar. 10, 1992, discloses self-propelled steerable sludge cleaning apparatus for cleaning sludge from the bottom of large liquid storage tanks. That apparatus, which had motor-driven crawler tracks and was able to move across the bottom of the tank along desired paths in accordance with a computer program, employed a horizontally disposed rotatable motor-driven auger for delivering sludge through a horizontal center-feed pipe to a motor-driven pump for subsequent disposal elsewhere. The auger had oppositely-wound helical auger flights at opposite ends and fed the sludge to the center-feed pipe located near the center of the auger. The motor-driven crawler tracks and associated components were relatively large and heavy and required a separate drive motor and associated controls to effect propulsion and steering.

My U.S. Pat. No. 4,574,501, issued Mar. 11, 1986, discloses underwater dredging apparatus of the crater sink type for dredging fluid material such as sand from an underwater area. That apparatus, which was stationary and positioned at a fixed location beneath a body of water by means of a crane, employed a horizontally disposed rotatable motor-driven auger for delivering sand through a vertical pipe to a motor-driven pump for subsequent disposal elsewhere. The auger had oppositely-wound helical auger flights at opposite ends and the vertical pipe was located near the center of the auger. That apparatus was incapable of self-propulsion to other locations.

Each of my prior art machines is well-adapted for its intended purpose but it is desirable to provide an improved apparatus for removing material from a confined area and which employs a horizontally-disposed motor-driven auger for supplying material to a motor-driven pump, such improved apparatus being self-propelled, steerable, more compact and less complex than prior art apparatus.

Heretofore, it was common practice in tank cleaning operations to decant the liquid in the tank into another container, to de-gas the tank to remove noxious vapors, and admit men into the tank through an access opening, such as a man-way in the side of the tank, with buckets and shovels to remove the sludge or sediment accumulated at the bottom of the tank. However, safety requirements aimed at limiting the exposure of working personnel to noxious vapors and liquids contained the tank are becoming more restrictive and expensive as time goes on. Therefore, it is desirable to eliminate the need for personnel to enter the tank and to limit the time clean-up personnel are exposed to the atmosphere within the tank while installing or removing automated cleaning equipment in the tank.

Furthermore, the need to decant the tank to be cleaned, as mentioned above, means that the tank must be taken out of service and this has very expensive consequences. For example, the liquid must be placed in another compatible container and tanks are very expensive. Furthermore, the tank to be cleaned is taken out of service and this is another expense. Also, an out-of-service tank could slow down or even stop an industrial process, resulting in a very expensive production cutback.

SUMMARY OF THE PRESENT INVENTION

The present invention provides improved self-propelled, steerable apparatus for removing material from the surface of a confined area for disposition elsewhere. The material may, for example, take the form of sludge which has settled at the bottom of a liquid storage tank such as a chemical or oil tank or the like.

The improved apparatus generally comprises a support frame or platform having top and rear walls; a horizontally disposed motor-driven rotatable auger beneath the platform; a motor-driven dredge or sludge pump mounted on the platform; and remotely operable steering means mounted on the platform.

The auger provides two functions. First, the auger cooperates with the walls of the support frame to define a passage in which sludge material can collect and be acted upon and moved by the rotating auger to the sludge pump. Second, the auger engages the floor of the confined area and its rotation propels the apparatus across the floor. Forward motion of the apparatus across the floor is restrained by a back-haul cable or tether which is periodically paid out by a remotely controllable winch in small increments to allow the apparatus to move forward a short distance, whereupon the back-haul cable prevents further forward motion while the auger continues to rotate and deliver sludge material to the sludge pump. Means are provided to supply by-pass liquid from a suitable source (and compatible with the sludge) to the aforesaid space to make the sludge more soluble and easier to handle by the auger and pump.

The dredge pump has a sludge inlet port communicating with the aforesaid space. The dredge pump also has a sludge discharge port connectable to a sludge discharge hose for disposing of the sludge exteriorly of the tank.

The remotely operable steering means comprises an elongated arcuately movable steering arm which extends rearwardly from the platform. One end of the steering arm is pivotally connected to the platform and a rotatable tail wheel is mounted at its other end. An extendible/retractable hydraulic ram is connected between the platform and the steering arm and is operable to pivotally move the steering arm and the tail wheel thereon to effect steering of the apparatus. The aforementioned back-haul cable or tether is connected to the tail end of the steering arm. During operation the apparatus is then lowered into a layer of sludge on the floor of a tank to be cleaned so that the edge of the auger and the tail wheel rest on the tank floor. Assuming that there is a small amount of slack in the back-haul cable, rotation of the auger then causes the apparatus to move across the tank floor in a direction transverse to the auger axis until it is stopped by the back-haul cable. With the apparatus at rest, sludge already in the aforesaid space between the platform and auger (and mixed with by-pass fluid to make it more fluid) is moved by the still-rotating auger toward the discharge end of the auger into the dredge pump and from thence through the discharge hose for final disposition. If the sludge is especially fluid, it can continue to flow into the space even though the apparatus is stationary. The back-haul cable, which is attached to the selectively controllable winch, controls the distance the apparatus can move across the tank floor. Paying out or reeling in the back-haul cable can control the position of the apparatus on the tank floor. Counter-torque movement of the platform in response to rotor torque forces the tail wheel firmly against the tank floor to achieve effective steering.

The auger can take various forms and the form chosen determines the behavior of the apparatus. If the auger has a single helical spiral, it rotates to feed sludge to an end outlet located at one end of the platform and connected to the sludge pump. In such an arrangement auger action tends to cause the apparatus to move or drift slightly in the axial direction of the auger but such drift is overcome by positioning the tail wheel so that it is at the "dynamic center" of the apparatus. The steering arm can be positioned either by pre-shaping the steering arm or by operating the steering cylinder to overcome the tendency of the apparatus to drift. Furthermore, the steering means enables the apparatus to be steered along arcuate paths across the tank floor.

If the auger has oppositely formed helical flights at opposite ends, the auger can feed sludge to a center outlet on the platform and the apparatus has no tendency to drift.

Apparatus in accordance with the present invention offers several advantages over the prior art. For example, it is constructed of a minimum number of components. The components of the apparatus are easily assembled and disassembled and can be assembled inside a tank which has a "man way" or access opening smaller than the fully assembled apparatus.

It can be quickly assembled and disassembled, thereby reducing the time operating personnel are exposed to toxic or noxious vapors near the man-way.

It does not require the tank to be taken completely out of service because it can be lowered into a tank which contains liquid having a layer of sludge at the bottom of the tank. This can result in monetary savings which easily exceed many times over the direct cost of cleaning the tank.

It can use the liquid in the tank as by-pass fluid to fluidize the sludge to be removed or can be supplied with by-pass liquid from an external source, if necessary.

It relies on the auger to process material, as well as to furnish motive power for the apparatus.

It is easily steered along desired paths by remote controls which are manually operable or programmable.

Other objects and advantages of the invention will hereinafter appear.

DRAWINGS

DESCRIPTION OF PREFERRED EMBODIMENTS

Figure 1:
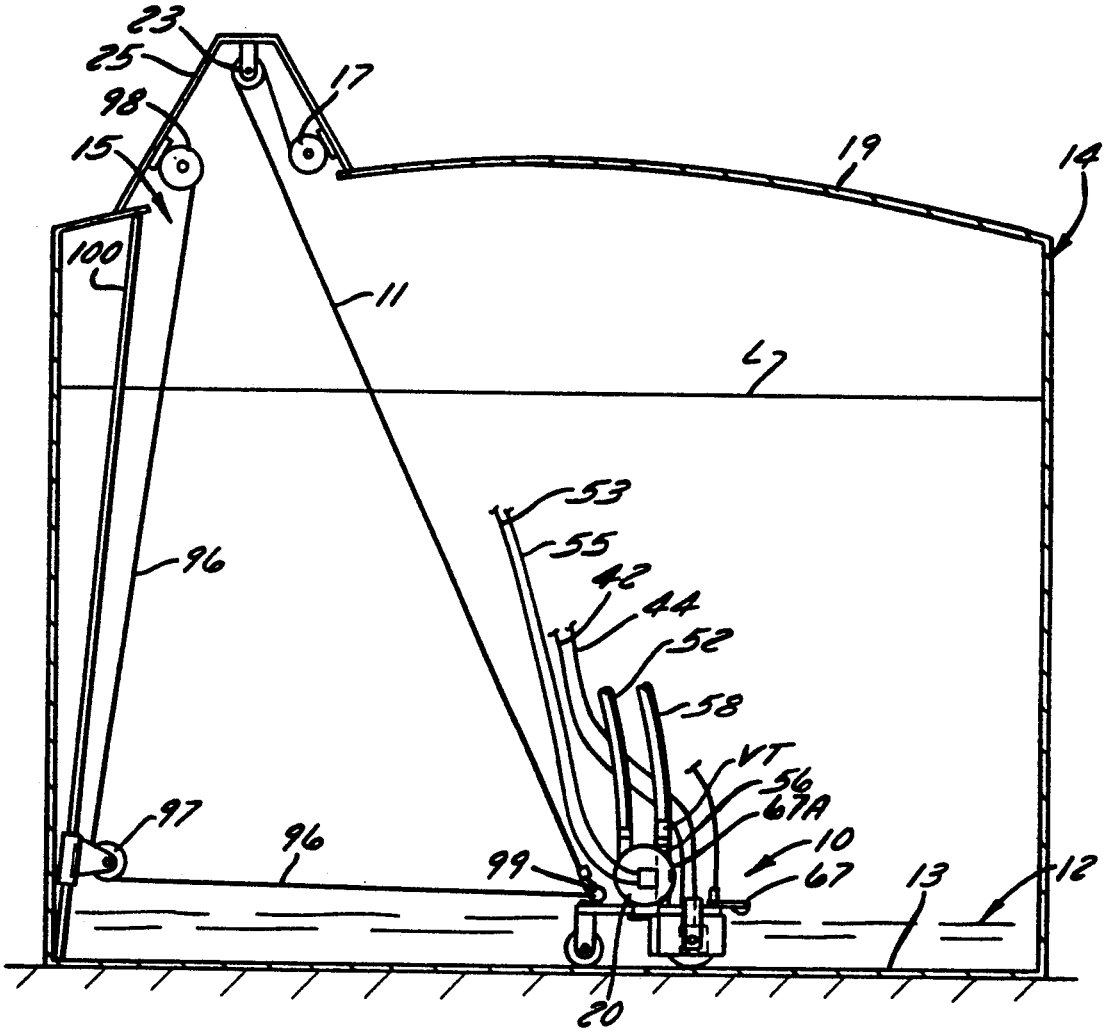
FIG. 1 is schematic view of a tank having apparatus in accordance with the invention disposed therein and associated components disposed thereon.
Figure 2:
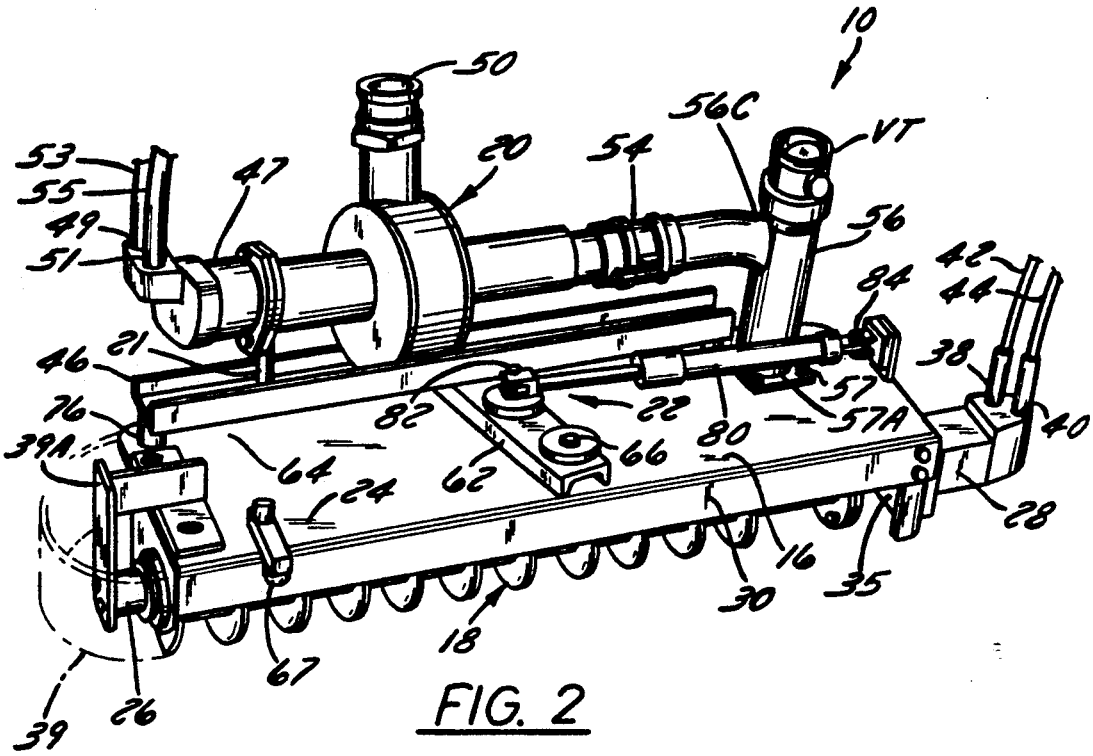
FIGS. 2 and 3 are perspective views of apparatus in accordance with the invention taken from the front side and left end thereof and from the rear side and right end thereof, respectively.

Referring to FIGS. 1 and 2, the numeral 10 designates a first preferred embodiment of improved self-propelled steerable apparatus in accordance with the present invention for removing material 12 from a confined area, such as the bottom surface or floor 13 of a storage tank 14, for disposition elsewhere. The material 12 may, for example, take the form of sludge which has settled at the bottom of a body of liquid L, such as a liquid chemical or oil, in a liquid storage tank such as a chemical or oil tank or the like. Tank 14, which is not shown in scale, could be on the order of 20 to 60 feet high and 25 to 100 feet in diameter and could be filled to a level about five feet below a man-way 15, for example.

Sludge layer 12 is assumed, for purposes of illustration, to be on the order of 10 to 15 inches deep but could be deeper, as hereinafter explained. For example, 10 to 15 inches is typical in petroleum tanks but in chemical processing tanks the depth can reach more than 20 feet.

Tank 14 is provided on top with an access opening or man-way 15 (typically 18 to 36 inches in diameter) through which apparatus 10 is lowered and recovered by means of a hoist cable 11 connected to a hoisting winch 17 temporarily mounted on the roof 19 of the tank. Hoist cable 11 is reeved around a pulley 23 supported on an A-frame mast 25 which is releasably bolted to the man-way flange. Preferably, mast 25 is provided with a crane (not shown) for raising the apparatus 10 and related equipment to the top 19 of tank 14. If man-way 15 is too small to accommodate fully-assembled apparatus 10, portions of the apparatus may be suspended on hoist cable 11 just below the man-way while being assembled/disassembled for lowering/raising relative to tank floor 13.

As hereinafter explained, apparatus 10 requires a back-haul cable or tether 96 to be attached thereto and this cable is connected to a motor-driven back-haul winch 98 which is also temporarily mounted on the top 19 of tank 14. Back-haul cable 96 is reeved around a rotatable back-haul cable pulley 97 which is swivelably mounted on a gin-pole mast 100 about 5 feet above floor 13 of tank 14. Mast 100 is rigidly secured to tank floor 13 and tank top 19. This arrangement enables apparatus 10 to move about floor 13 while keeping cable 96 taught.

Figure 9:
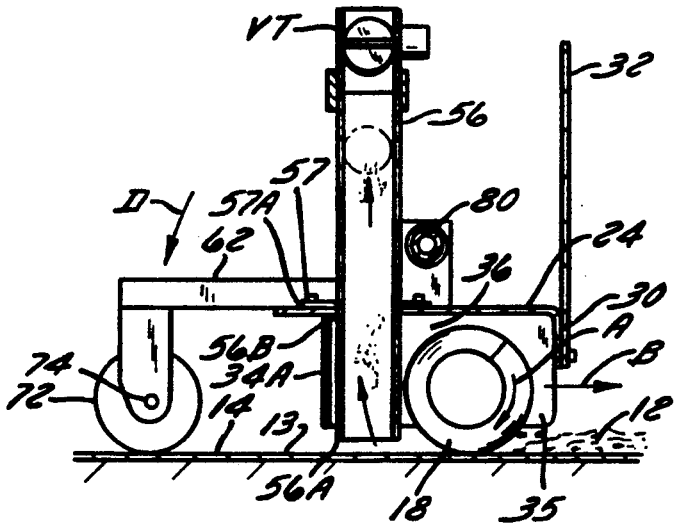
FIG. 9 is a cross-section view taken on line 9—9 of FIG. 5.

Referring now to FIGS. 2 through 9, the improved apparatus generally comprises a support frame or platform 16 having top and rear walls; a horizontally disposed motor-driven reversely rotatable auger 18 beneath the platform; a motor-driven dredge or sludge pump 20 mounted on the platform; and remotely operable steering means 22 mounted on the platform. Platform 16 comprises a top wall or upper deck 24 beneath which auger 18 is rotatably mounted, being supported at one end by a bearing 26 mounted at one end of the platform on a bearing support bracket 39A. Auger 18 is supported at its other end by a reversible hydraulic motor 28 which is mounted on plate 35 at the other end of the platform and connected to said other end of the auger. Platform 16, which in an actual test embodiment was a steel plate about 40" long, 12" wide and ¼" thick, has a downwardly extending front lip 30 to which a lip extension 32 (portion shown in FIG. 5) is attached. Lip extension 32 serves several purposes, namely: to extend below lip 30 to control the amount of material entering auger 18; to act as a dozer blade to guide material 12 to the auger; to limit penetration of apparatus 10 into the material; and, if extended upwardly above deck 24, as shown in FIG. 9, to as much as 2 or 3 feet, operates to prevent material from flowing over the top of the apparatus.

Figure 10:
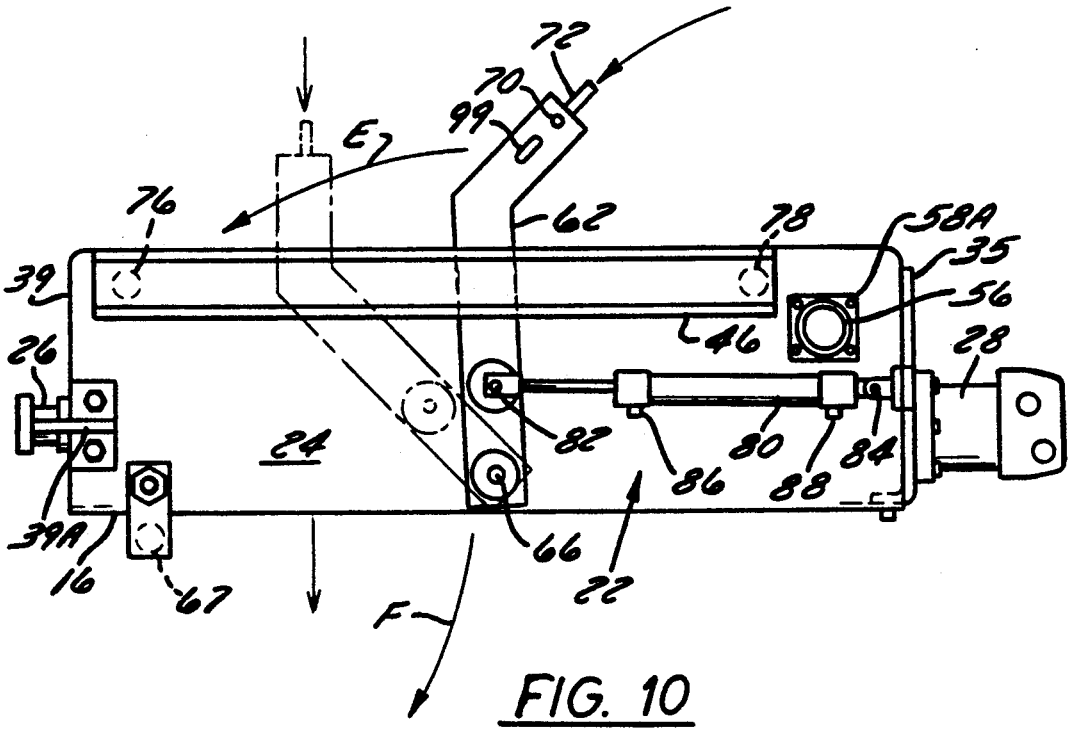
FIG. 10 is an enlarged top plan view of the apparatus with the pump deleted and showing the steering arm, the slide bearing and the steering ram of the apparatus.
Figure 11:
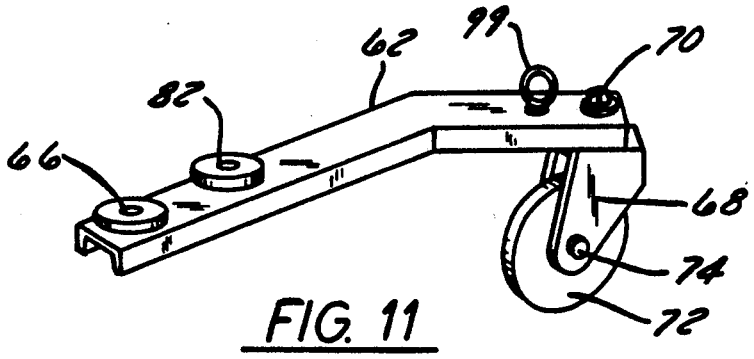
FIG. 11 is a perspective view of the steering arm and the tail wheel.

Referring to FIG. 9 and 10, a rear sealing plate or wall 34 extends downwardly from beneath the rear of deck 24 and cooperates with auger 18 to define a space or passage 36 for accumulating the material so it can be moved or transported by the auger to pump 20 as the auger rotates. As FIGS. 2, 2A, 3 and 3A show, end plate 35 closes one end of passage 36 and another removable end plate 39 curves around bearing support bracket 39A and bearing 26 and closes the other end of the passage.

Rear sealing plate 34 has a curved portion 34A to allow space for the lower portion of a T-shaped conduit 56 hereinafter described in detail which extends into and communicates with space 36 between auger 18 and rear sealing plate 34.

Figure 3:
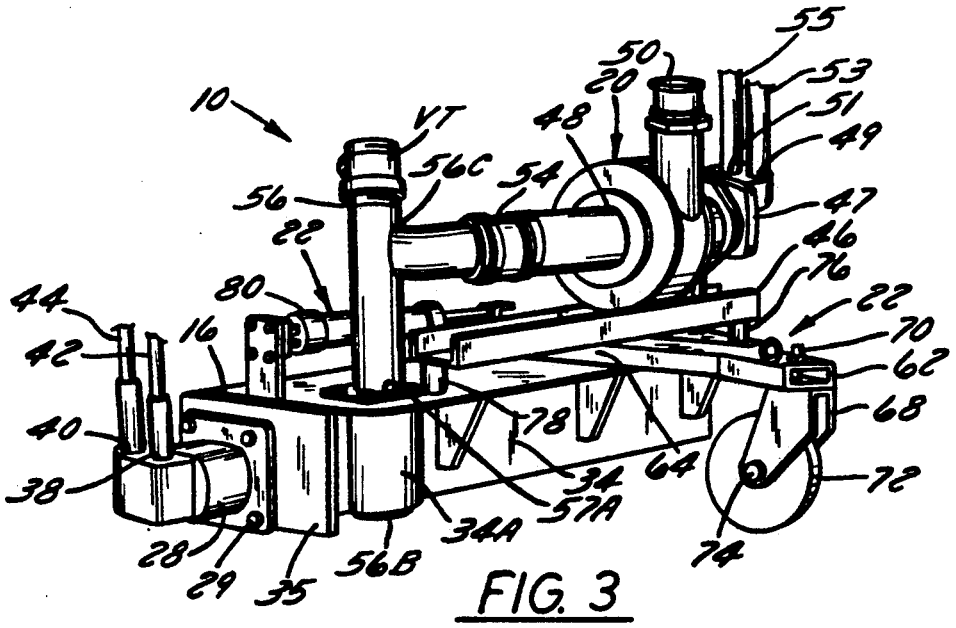
Figure 2A:
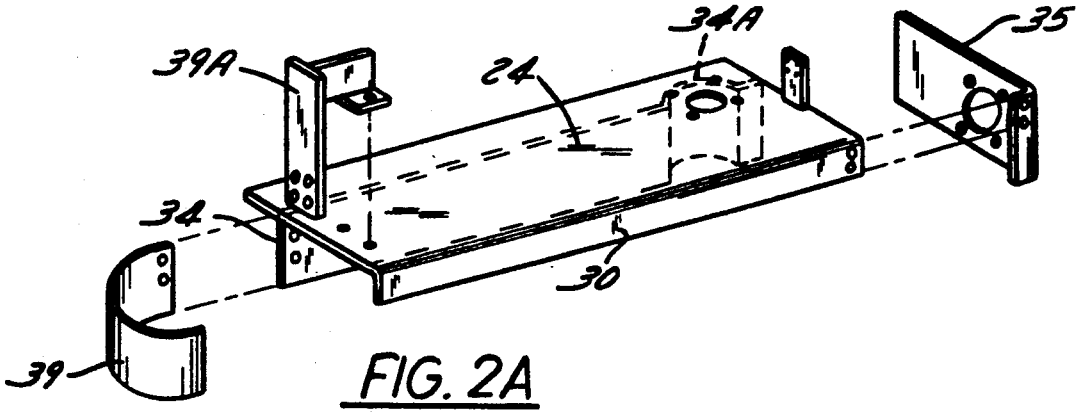
FIGS. 2A and 3A are perspective views of the platform of apparatus in accordance with the invention taken from the front side and left end thereof and from the rear side and right end thereof, respectively.
Figure 2B:
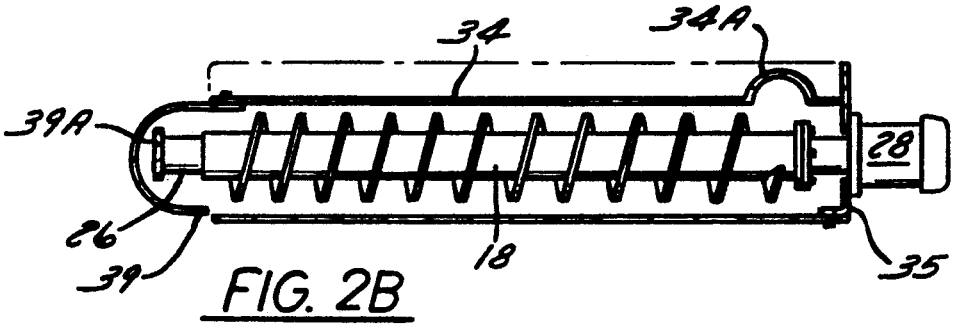
FIG. 2B is a bottom plan view of the platform of the apparatus showing details thereof and the auger.
Figure 4:
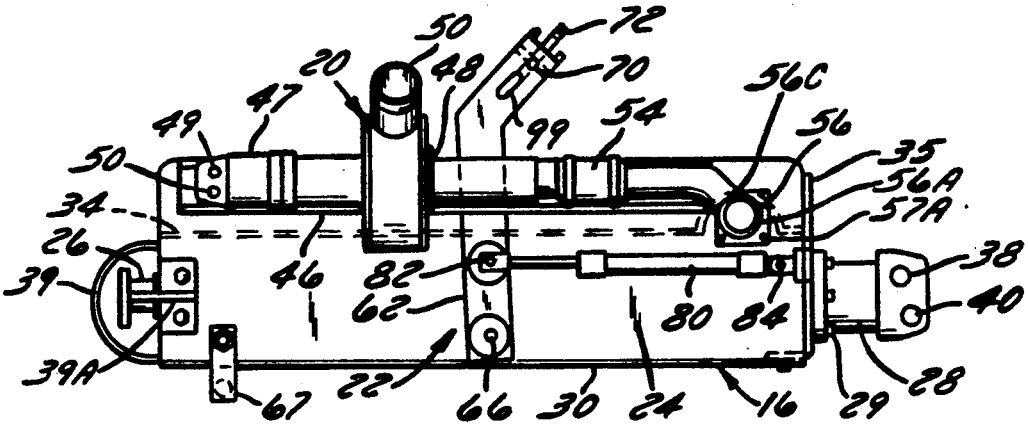
FIG. 4 is a top plan view of the apparatus.
Figure 5:
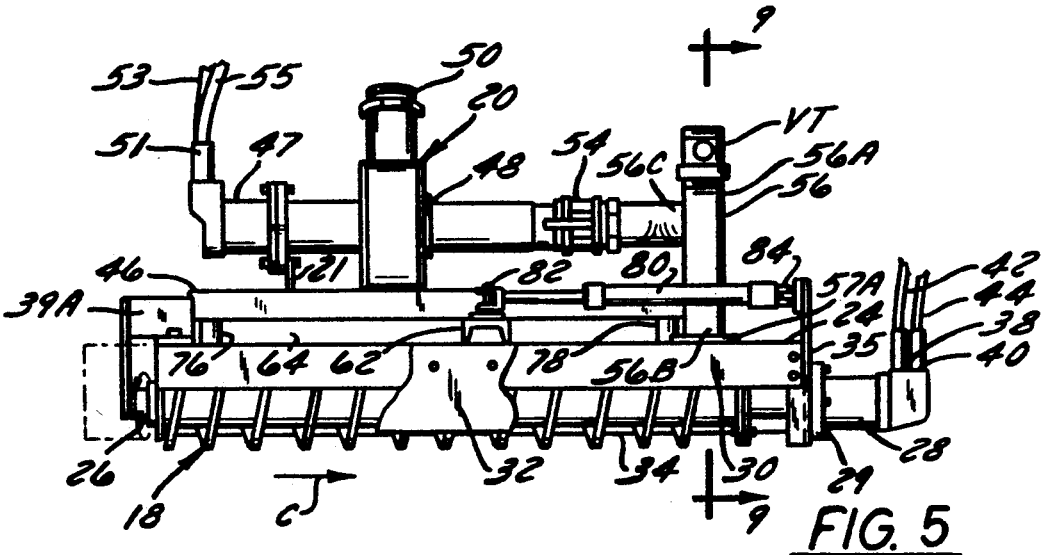
FIG. 5 is an elevation view of the front side of the apparatus.
Figure 12:
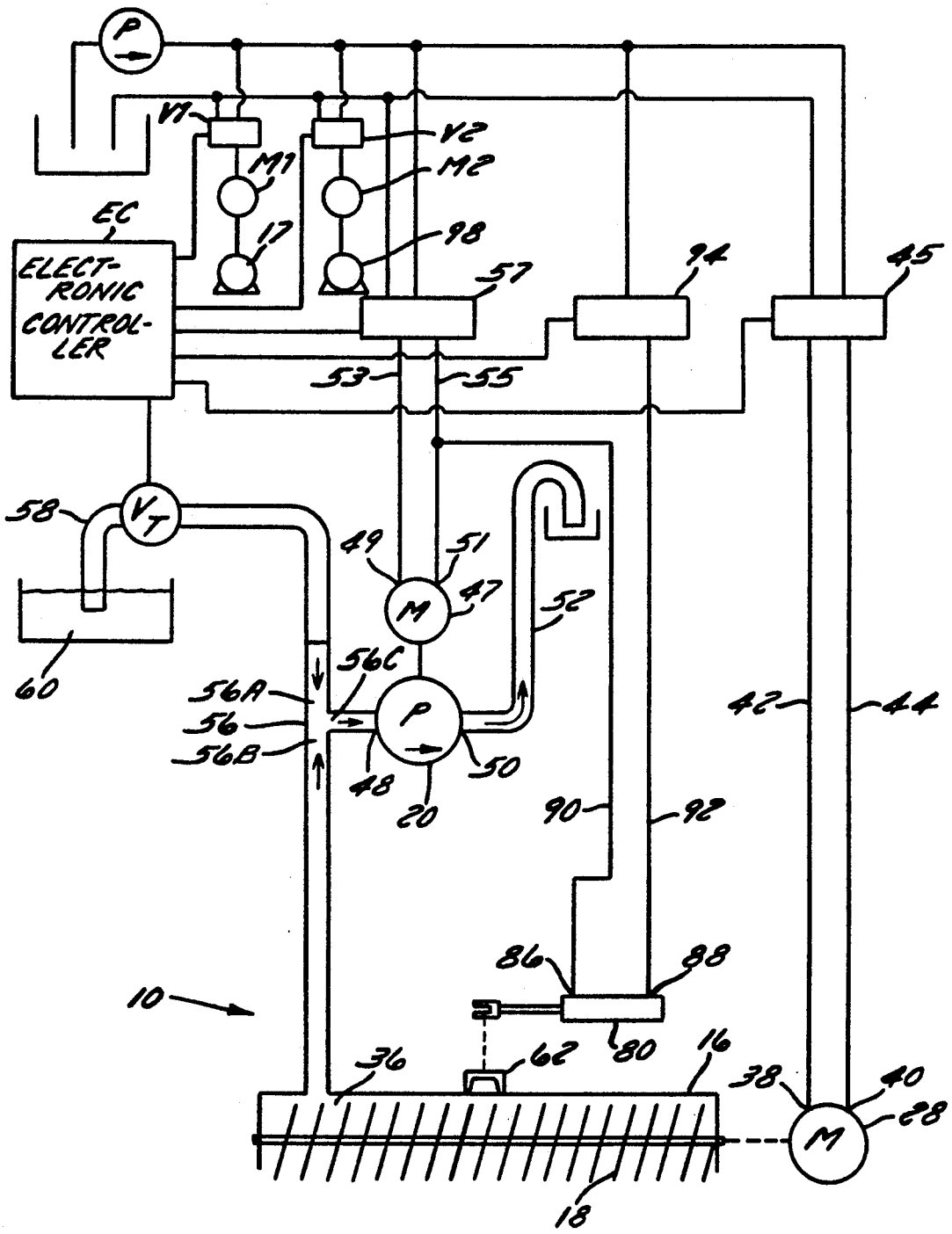
FIGS. 12 and 12A are schematic views of an elementary control system for the apparatus.

As FIGS. 3 and 4 show, hydraulic motor 28 for auger 18 is rigidly but detachably connected by bolts 29 to plate 35 and has hydraulic fluid inlet/outlet ports 38 and 40 which are connected by hydraulic fluid lines 42 and 44, respectively, to an auger motor control valve 45 shown in FIG. 12.

If preferred, auger 18 may be constructed as hollow so that bearing 26 and motor 28 may be mounted internally thereof to make apparatus 10 even more compact.

Figure 3A:
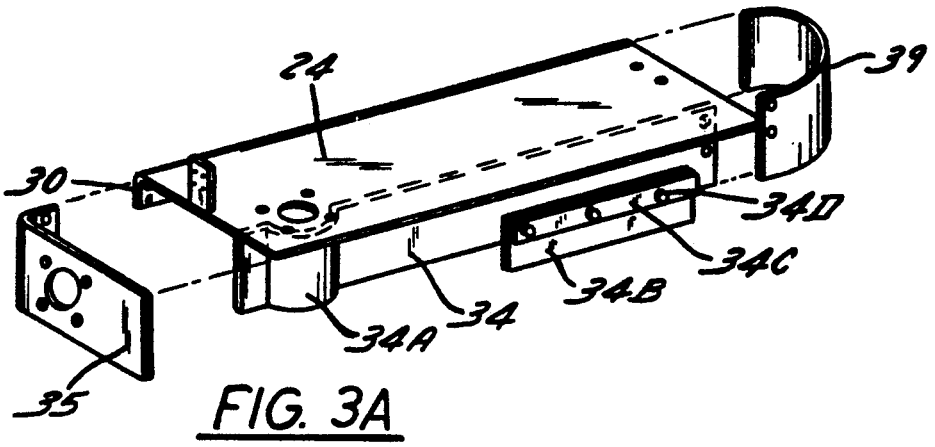
Figure 7:
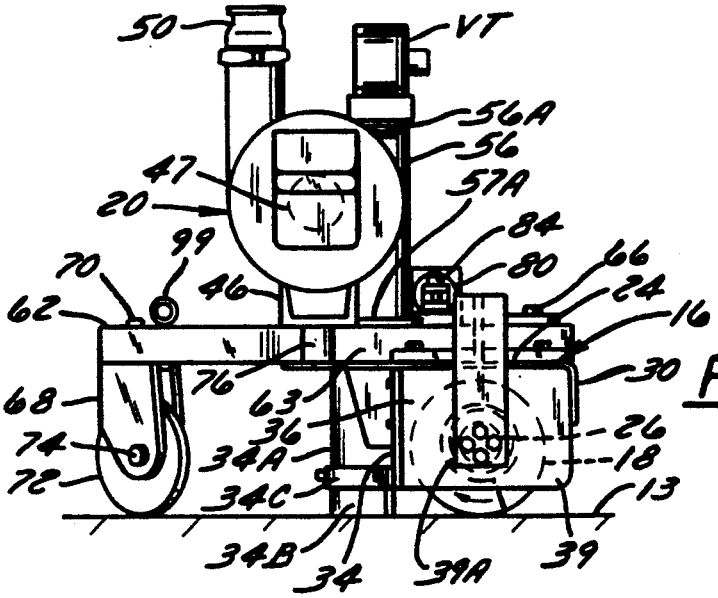
FIG. 7 is an elevation view of the left end of the apparatus.
Figure 8:
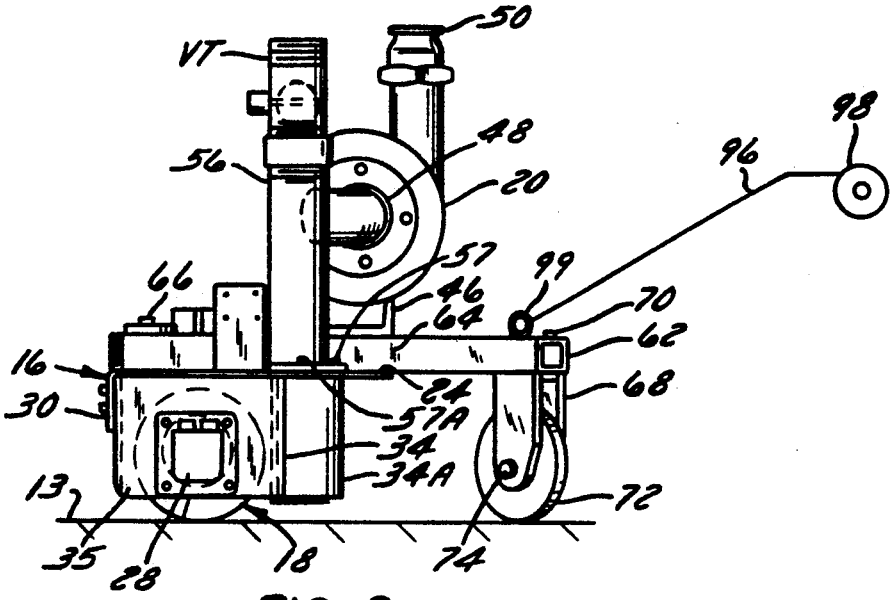
FIG. 8 is an elevation view of the right end of the apparatus.

As FIGS. 3A and 7 show, rear plate 34 extends downwardly so that its lower edge edge is about 1 inch above the floor 13 of tank 14. To allow for an uneven floor 13 or projections (not shown) a rubber or neoprene flexible sealing lip 34B engageable with the floor is secured to rear plate 34 by entrapment between rear plate 34 and a rigid mounting strip 34C which is secured to the rear plate by a series of bolts 34D. The sealing lip 34B drags along floor 13 and effectively seals the gap between the plate 34 and the floor against leakage of the sludge material to be removed by auger 18.

As FIGS. 2 through 10 show, steering means 22 (hereinafter described in detail) comprises an elongated rigid slide-bearing member 46 which is rigidly mounted on the upper side of deck 24 in spaced apart relationship therefrom and parallel to auger 18. Dredge pump 20, which has a sludge inlet port 48 and a sludge discharge port 50 connectable to a discharge hose 52, is rigidly but detachably mounted on slide-bearing member 46 by brace 21. Dredge pump 20 is driven by a hydraulic dredge pump motor 47 which has hydraulic fluid inlet/-outlet ports 49 and 51 which are connected by hydraulic fluid lines 53 and 55 which are connected to a pump control valve 57, as FIG. 12 shows.

Figure 6:
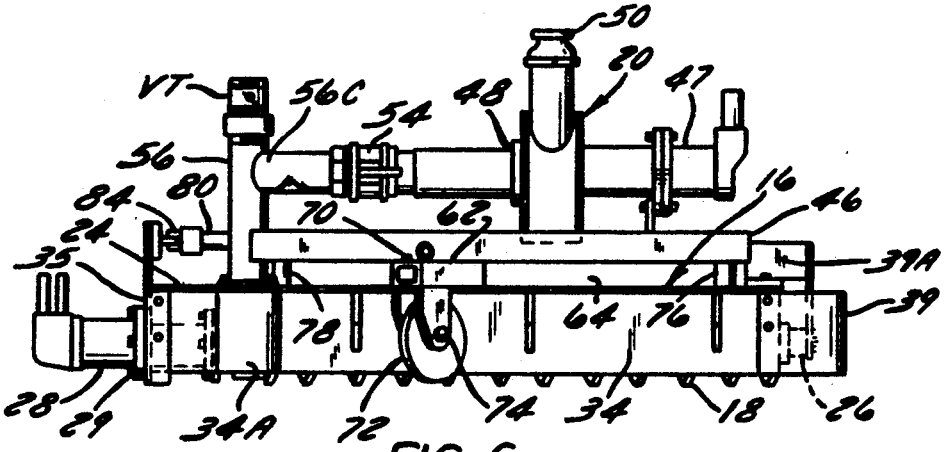
FIG. 6 is an elevation view of the rear side of the apparatus.

Pump inlet port 48 is connected by a quick-disconnect coupling 54 to a T-shaped conduit 56. More specifically, T-shaped conduit 56, is rigidly but detachably mounted on platform 16 by bolts 57 extending through a flange 57A (FIG. 9) to enable it to be installed on the platform after the components have been inserted through the man-way 15. Conduit 56 has an upper by-pass liquid inlet port 56A, a lower sludge inlet port 56B and an intermediate sludge outlet port 56C. Sludge inlet port 56B communicates with the aforesaid space or passage 36, as FIGS. 6 and 9 show, and extends downwardly to within about one or two inches of tank floor 13.

By-pass liquid inlet port 56A is provided with an adjustable, remotely controllable throttle valve VT (FIG. 3). Valve VT is operable to admit only a desired amount of by-pass liquid to sludge pump 20 to facilitate the desired flow of the sludge. The by-pass fluid must be compatible with the liquid in tank 14. In fact, in most cases the by-pass fluid is the liquid in the tank and it can flow directly into valve VT. In rare cases, by-pass liquid from an external source may be required and the valve VT may be used to detachably connect liquid inlet port 56A to a by-pass liquid supply hose 58 which, as FIG. 12 shows, is connected to a by-pass liquid supply 60. Sludge discharge port 56C is connected by coupling 54 to sludge inlet port 48 of pump 20. The bypass liquid must be compatible or miscible with the sludge being removed and mixes with the sludge to render it more easily transported by pump 20.

Referring to FIGS. 2, 3, 4, 5, 6, 7, 8, 10 and 11, remotely operable steering means 22 comprises an elongated rigid L-shaped steering arm or member 62 which extends through a space 64 between upper deck 24 and slide-bearing member 46. One end of steering-arm 62 is pivotally connected to deck 24 by a pivot pin 66. The other end of steering arm 62 is provided with a wheel support bracket 68 which is rigidly connected thereto as by a bolt 70. A tail wheel 72 is rotatably mounted on bracket 68 by an axle 74. Spaced-apart members 76 and 78 are mounted beneath and near opposite ends of slide-bearing member 46 to rigidly support it on deck 24.

Figure 12A:
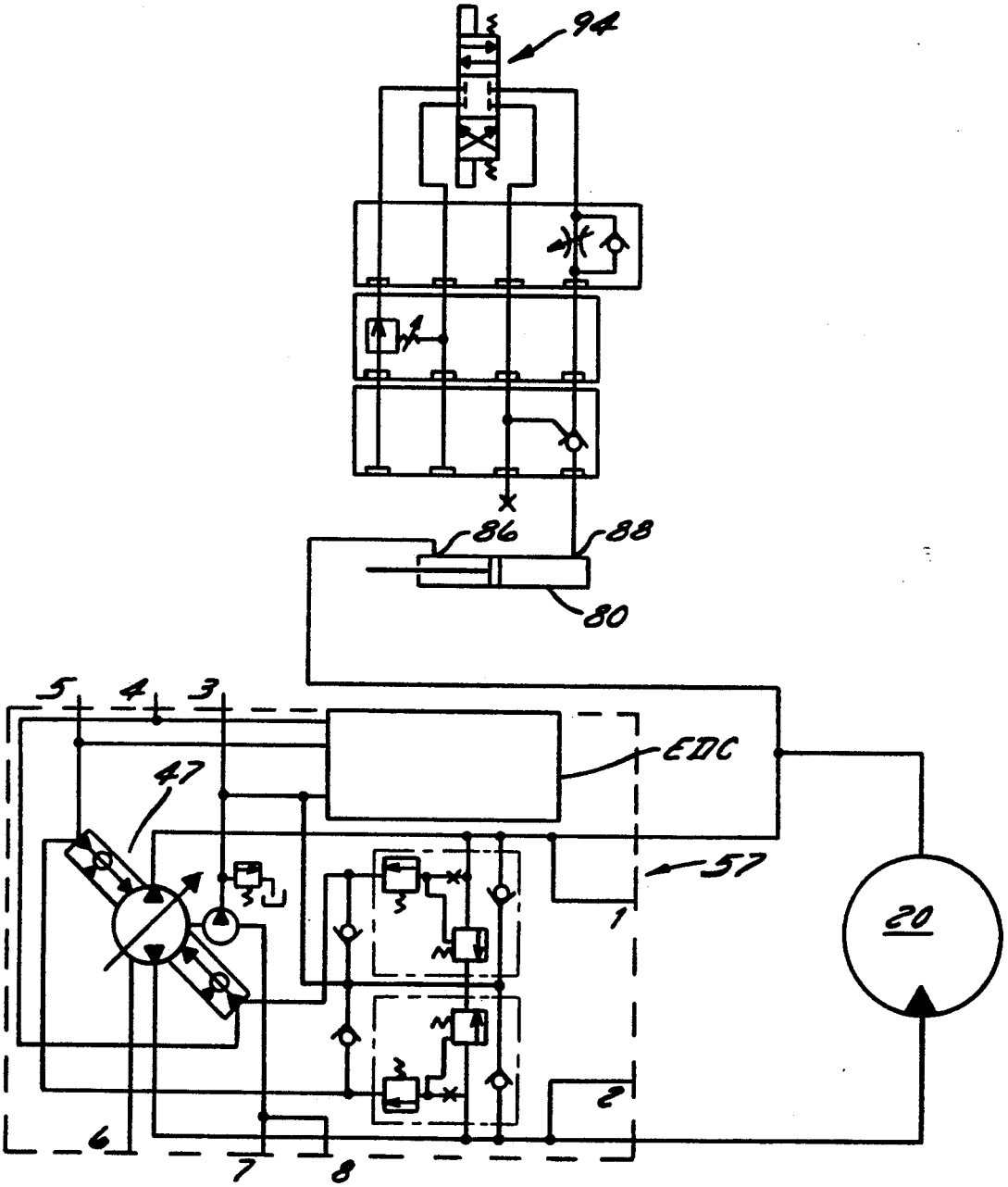

An extendible/retractable hydraulic ram or steering cylinder 80 is connected between deck 24 and steering arm 62 by pivot pins 82 and 84 and is operable to pivotally move the steering arm and the tail wheel thereon to effect steering of the apparatus. Ram 80 is provided with hydraulic fluid inlet/outlet ports 86 and 88 which are connected by hydraulic fluid lines 90 and 92, respectively. Line 92 is connected to a steering control valve 94 and line 90 is connected to return line 51 of the hydraulic motor 20, as FIGS. 12 and 12A show. Ram 80 is supplied at one end with hydraulic fluid at a constant pressure of 300 psi, for example, and this creates a bias in one direction. The other end of ram 80 is supplied with hydraulic fluid of variable pressure to effect steering.

Referring to FIG. 10, if steering arm 62 is swung all the way in the direction of arrow E, apparatus 10 tries to pivot in an arc in the direction of arrow F. Movement of steering arm 62 in the opposite way causes apparatus 10 to pivot oppositely in an arc. If the steering-arm is positioned in its dynamic center as shown broken lines in FIG. 10, apparatus 10 will tend to move straight ahead. It should be noted that tail wheel 72 is straight when steering arm 62 is in its dynamic center so as to off-set the unwanted shift of apparatus 10 caused by auger rotation.

Back-haul cable or tether line 96 is connected between winch 98 and a hook 99 on steering arm 62.

As FIG. 1 and 2 show, the apparatus is provided with a jet nozzle 67 for supplying a pressurized stream of compatible liquid to assist in fluidizing the material to be dredged, if this becomes necessary, as hereinafter explained. Nozzle 67 is provided with liquid through a supply hose 67A (FIG. 1) from a suitable pump (not shown). The source of liquid may be filtered liquid which is being returned to tank 14 or can be any compatible liquid. Preferably, nozzle 67 is a known type of back-thrust or balanced nozzle located so as not to interfere with the steering or operation of the apparatus.

OPERATION

It should be understood at the outset that the material 12 to be dredged is similar in its characteristics to sand on an ocean floor in that it is not in itself fluid or fluidized until action is taken to do so. The material can be very fine and packed and needs to be fluidized before it can be handled by pump 20. However, in some cases it may be an organic type material that behaves like a fluidized material without the need to take steps to fluidize it. Note that in the dredging industry material mixed with a liquid to fluidize it is referred to as a slurry and the slurry density is the ratio of material to liquid.

Generally considered, the present apparatus fluidizes the material 12 in the following manner:

(a) the action of auger 18 stirs up the material while moving the material in the direction of inlet port 56B which is connected to the inlet of pump 20;

(b) pump 20 causes fluidization of the material by mixing it with by-pass liquid supplied through throttle valve VT to inlet port 56A;

(c) the forward motion of the apparatus across tank floor 13 also helps in fluidizing the material;

(d) the apparatus operates at the bottom of the slope of the material which it confronts and the material has a natural tendency under the force of gravity to roll to the bottom of the slope, although in some cases the weight of the material becomes greater than its shear resistance, motion occurs and the motion causes fluidization;

(e) in some cases all of the above actions are insufficient to fluidize the material and it is necessary to employ a jet of liquid from jet nozzle 67 which is pointed in the digging direction.

Assume that the apparatus 10 is disposed in tank 14 as shown in FIG. 1, that by-pass liquid supply hose 58 is connected, if needed, that throttle valve VT is opened the proper amount, that discharge hose 52 is properly connected, and that the hydraulic fluid control hoses described above are connected to the winches 17 and 98, to hydraulic pump motor 47, to hydraulic auger motor 28 and to hydraulic steering ram 80. Further assume that back-haul cable or tether 96 is connected to hook 99 at the end of steering arm 62.

If the layer of material is relatively deep (i.e., more than 10 to 15 inches deep when apparatus of the size disclosed herein is employed) and very viscous, other equipment may be used to excavate a hole in the layer of material so that apparatus 10 can reach floor 13. Such equipment may take the form of a crater sink mechanism (not shown) which is disclosed in my U.S. Pat. No. 4,979,322 issued Dec. 25, 1990. As previously mentioned, the sludge depth in a chemical processing tank can reach more than 20 feet. The apparatus 10 cannot work in mid-material but must be in contact with the floor 13 of the tank and the apparatus disclosed in U.S. Pat. No. 4,979,322 can be lowered through the manway to excavate a crater in the sludge into which the apparatus can descend to the floor.

Now assume that the edge of auger 18 and tail-wheel 72 rest on the tank floor. Rotation of auger 18 then causes apparatus 10 to move in a direction transverse to the auger axis and at the same time moves material toward the discharge end of the auger, through T-shaped conduit 56 and into dredge pump 20 and from thence through discharge hose 52 for final disposition.

Figure 14:
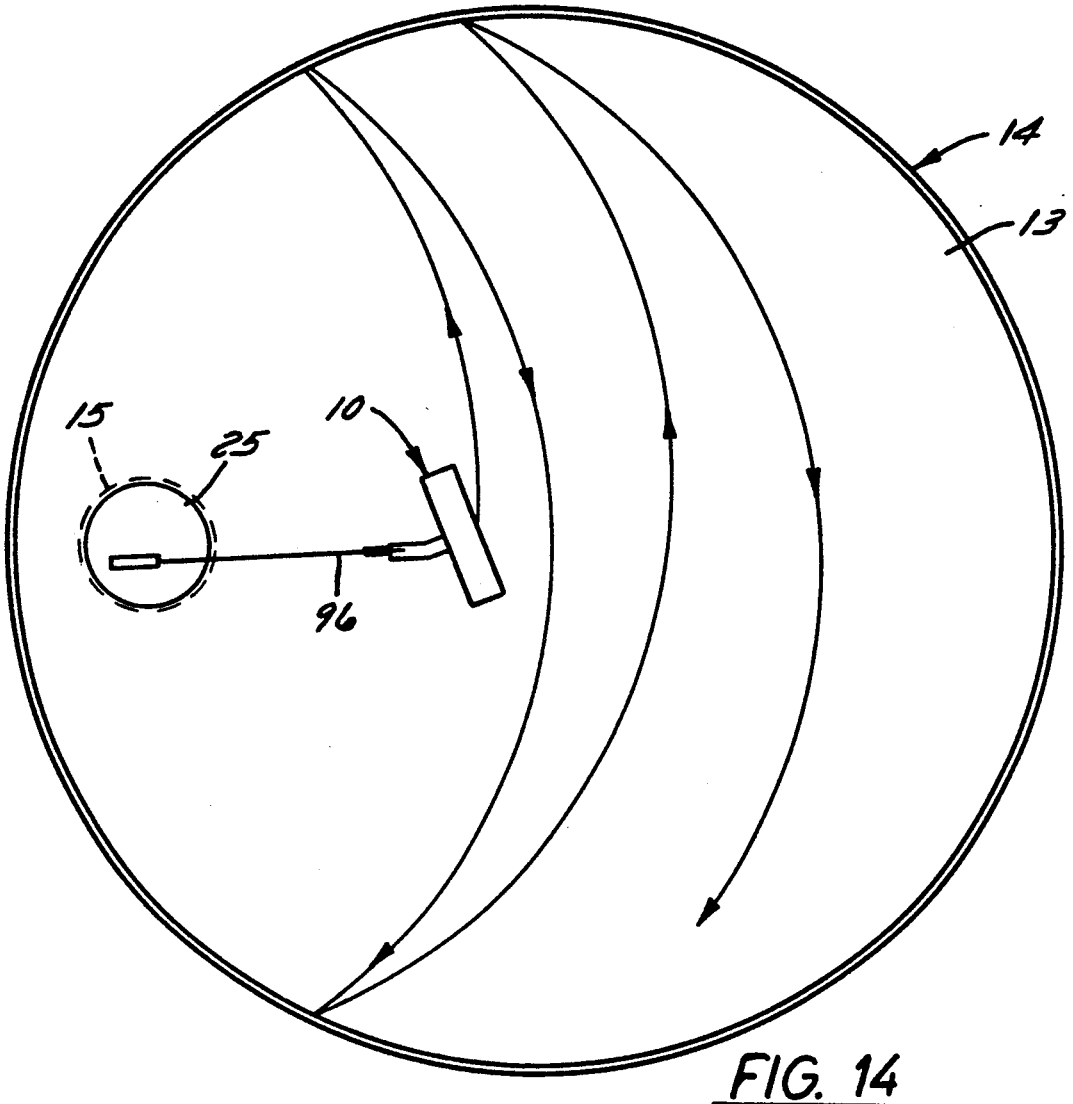
FIG. 14 is a schematic view showing a typical path of movement of apparatus in accordance with the invention.

As FIG. 14 shows, during a cleaning operation the apparatus moving forward first sweeps in an arcuate path to the left. Then, the position of the steering arm 62 is reversed, the apparatus turns around and the apparatus moves forward and sweeps in an arcuate path to the right. This sweep maneuver sequence is repeated as often as necessary to cover the area to be cleaned. While dredging, the auger 18 always rotates in the forward direction and the apparatus always moves in the forward direction. The auger is only operated in reverse to back away from the tank wall and aid the apparatus in turning.

The forward progress of the apparatus is dependent on the depth and type of material 12. It is to be understood that the auger rotates at a speed of between 0 and 30 rpm. If auger 18 is 10 inches in diameter and the angular (rotational) velocity is 30 rpm, assuming no slip, then the maximum forward velocity would be about 20 feet per minute or 1,178 feet per hour.

It is to be further understood that the back-haul cable 96 is paid out as the apparatus 10 moves forward. The cable 96 is fed out only about one foot at a time. Cable is taken in to pull the apparatus in reverse, as while attempting to move it away from the tank wall during a turn. Care must be taken so as not to allow the apparatus to run over the back-haul cable.

Referring to FIG. 9, if auger 18 is rotating clockwise in the direction of arrow A, apparatus 10 tends to move forward in the direction of arrow B and auger action tends to move material to the sludge inlet port 56B of the apparatus and from thence to pump 20. However, such auger rotation also tends to move apparatus 10 slightly in the general direction of arrow C in FIG. 5. Furthermore, the torque of auger 18 turning in the direction of arrow A tends to cause platform 16 to rotate counter-clockwise in the direction of arrow D in FIG. 9, thus causing a downward force to be exerted on tail wheel 72 to stabilize the apparatus and improve steering.

As previously mentioned, the auger 18 can take various forms and the form chosen determines the behavior of the apparatus 10. If the auger has a single helical spiral, as is the case with auger 18, it rotates to feed sludge to an outlet 56B located at one end of platform 16. However, in such an arrangement auger action tends to cause the apparatus to move or drift slightly in the axial direction of the auger, but such drift is overcome by positioning the tail wheel 72 so that it is at the "dynamic center" of the apparatus. The steering arm 62 can be positioned either by pre-shaping the steering arm (notice the L-shaped configuration in FIG. 10) or by operating the steering cylinder 80 to overcome the tendency of the apparatus to drift.

Figure 13:
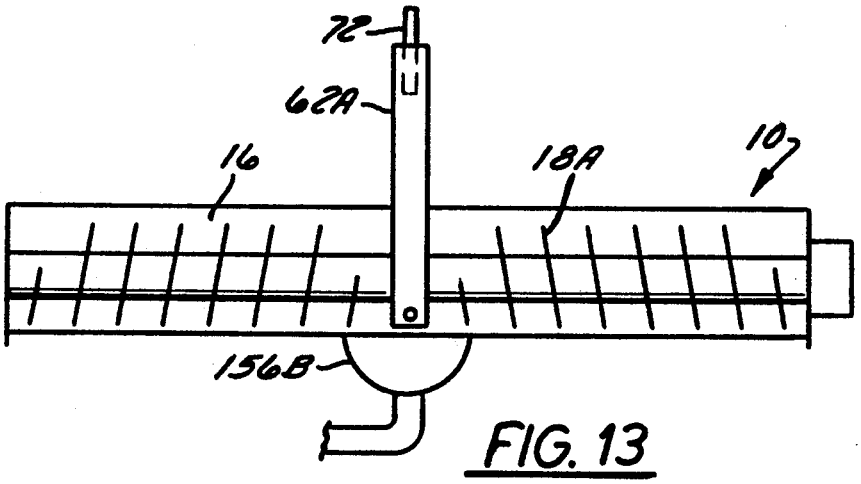
FIG. 13 is a schematic top plan view of another embodiment of the invention.

If, as shown in FIG. 13, the auger 18A has oppositely formed helical flights at opposite ends, the auger can feed sludge to a center outlet 156B on platform 16 and the apparatus has no tendency to drift. As a result, the steering arm 62A for tail wheel 72 can be made straight and centrally located.

Referring to FIG. 1, it is apparent that the system disclosed therein requires various motors to drive auger 18, pump 20, steering arm 62, load hoist winch 17 and back-haul winch 98. Such motors are preferably hydraulic rather than electric because some tank cleaning operations take place in a flammable or explosive environment. The valves which control the several motors are solenoid-operated hydraulic control valves which are remotely located exteriorly of tank 14 and operated by a programmable electronic controller EC which can be manually over-ridden when necessary. Such a controller is disclosed in my aforementioned U.S. Pat. No. 5,093,949.

Typically, the winch motors M1 and M2 for the winches 17 and 98, respectively, are selectively operable by means of solenoid valves V1 and V2. The solenoid valves 45, 57 and 94 for the auger motor 28, the pump motor 47 and the steering ram 80, respectively, readily lend themselves to programmable sequences of operation. Throttle valve VT is operable to control the flow of by-pass liquid to pump 20. The sludge pump 20 preferably takes the form of a variable displacement pump. Referring to FIGS. 12 and 12A, the sludge pump 20, which is hydraulically driven, is supplied with oil by means of a positive displacement control unit EDC. This type of control easily lends itself to remote control, either manually or by an electronic programmable controller EC.

When a cleaning operation is ready to begin, the pump 20 is started and brought up to design speed and the steering arm 62 is centered. Effluent discharge rate and pressure are checked. If all is in accordance with design specifications, auger 18 is slowly speeded up to rated speed for the particular operation.

The back-haul cable 96 is fed out about 6 inches and the pump performance is closely monitored. Then, the back-haul cable 96 is slowly paid out and, at some point, the apparatus will stall against the material 12. If it does not stall, three to five more feet of cable 96 is paid out.

When the material output diminishes, the steering arm 62 is adjusted to steer the apparatus to the left and the speed of auger 18 is adjusted to maintain the rate of material pumping that is best suited to the particular operation. When the apparatus reaches the left side of the tank 14, the steering arm 62 is turned to the right but no back-haul cable 96 is paid out.

When the apparatus reaches the opposite (right) side of the tank 14, the steering arm 62 is turned to the left and, as the apparatus moves to the left, another foot of back-haul cable 96 is paid out. All necessary controls are then adjusted to obtain optimum production for the conditions encountered.

When cleaning is finished, the apparatus is turned off and hoist winch 17 is operated to raise the apparatus to man-way 15 whereat it is disassembled, if necessary, withdrawn from the tank and lowered to the ground.

I claim:

1. Tank cleaning apparatus for removing sludge material from a solid, rigid floor surface of a tank for disposition elsewhere comprising:

a support frame, auger means comprising an elongated auger rotatably mounted on and cooperable with said support frame to define a material transport passage and engageable with said rigid floor surface, said auger means being operable to transport said material on said floor surface through said passage for disposition and to propel said apparatus across said floor surface, a hydraulic motor connected directly to and rotatably supporting an end of said auger for rotatably driving said auger, and a hydraulic pump for driving said motor.

2. Apparatus according to claim 1 further comprising a back-haul cable and a controllable winch, said cable connected to said winch and to said apparatus to selectively restrain propulsion of said apparatus across said surface while said auger is transporting said material.

3. Apparatus according to claim 1 further comprising a sludge pump connected to said frame for receiving material transport by said auger, and a second hydraulic motor connected to and for driving said sludge pump.

4. Tank cleaning apparatus for removing material from a floor surface of a tank for disposition elsewhere comprising:

a support frame, an auger rotatably mounted on and cooperable with said support frame to define a material transport passage and engageable with said surface, said auger being operable to transport said material on said surface through said passage for disposition and to propel said apparatus across said surface, a hydraulic motor connected to an end of said auger for rotatably driving said auger, and a hydraulic pump for driving said motor;

said apparatus further comprising a back-haul cable and a controllable winch, said cable connected to said winch and to said apparatus to selectively restrain propulsion of said apparatus across said surface while said auger is transporting said material, an elongated arm swingably connected at one end to said frame, and a wheel mounted on the other end of said arm for engaging said surface and steering said apparatus in a desired path across said surface.

5. Apparatus for removing material from a surface of a confined area for disposition elsewhere comprising:

a support frame, a sludge pump mounted on said frame and operable to receive and expel material for disposition at a desired location;

an auger operable to transport said material on said surface to said sludge pump and engageable with said surface to propel said apparatus across said surface; and an elongated swingable arm mounted at one of its ends to said frame and having a tail wheel at its other end for engaging said surface and steering said apparatus in a desired path across said surface.

6. Apparatus according to claim 5 further comprising a back-haul cable, a controllable winch, said cable connected to said winch and to said apparatus to selectively restrain propulsion of said apparatus across said surface while said auger is transporting said material.

7. Self-propelled steerable apparatus for removing material from a surface of a confined area for disposition elsewhere comprising:

support means;

rotatable auger means rotatably mounted on said support means and cooperating with said support means to define a space for receiving said material when said rotatable auger means is engaged with said surface;

a sludge pump on said support means and driven by a hydraulic motor and operable to receive material and deliver it to a specific location;

a hydraulic motor connected to and to effect rotation of said auger means to effect delivery of material from said space to said pump and to effect population of said apparatus across said surface;

and steering means including an elongated swingable arm mounted at one end on said support means and having a tail wheel mounting at the other end of said arm and engageable with said surface to effect movement of said apparatus along a desired path.

8. Apparatus according to claim 7 further comprising means to selectively restrain propulsion of said apparatus across said surface while said auger means is transporting said material.

9. Self-propelled steerable apparatus for removing material from a surface of a confined area for disposition elsewhere comprising:

support means comprising a top wall, a rear wall and opposite end walls;

rotatable auger means rotatably mounted on said support means beneath said top wall and cooperating with said walls to define a space for receiving said material when said rotatable auger means is engaged with said surface;

pump means on said support means and having an inlet port and a discharge port, said pump means being operable to receive material at said inlet port from said space and deliver it through said discharge port to a specific location for disposition;

means to effect rotation of said auger means to effect delivery of material from said space to said pump and to effect propulsion of said apparatus across said surface;

steering means including an elongated steering arm pivotally connected at one end to said support means and a tail wheel rotatably mounted on the other end of said steering arm and engageable with said surface to effect movement of said apparatus along a desired path and, means to selectively effect pivotal movement of said steering arm; and means to selectively restrain propulsion of said apparatus across said surface while said auger means is transporting said material.

10. Apparatus according to claim 9 wherein said auger means comprises a helical auger flight which is wound in the same direction along its entire length and wherein said inlet port of said pump communicates with said space at a location near one end of said auger flight.

11. Apparatus according to claim 9 wherein said auger means comprises two helical auger flights which are wound in opposite directions relative to each other and wherein said inlet port of said pump communicates with said space at a location near the region whereat said two auger flights join.

12. In combination:

a liquid storage tank having a rigid floor surface on which a layer of material has accumulated and having a tank top with an access opening therethrough;

self-propelled steerable apparatus for removing said material from said surface for disposition elsewhere, said apparatus comprising: support means; auger means cooperable with said support means to define a material transport passage and engageable with said surface, said auger means being operable to transport said material on said surface through said passage for disposition and to propel said apparatus across said surface; pump means for receiving material transported by said auger means; and means for steering said apparatus in a desired path across said surface;

hoist winch means having a hoist cable attached to said apparatus for lowering and raising said apparatus relative to said surface through said access opening;

back-haul winch means having a back-haul cable extending through said access opening and connected to said apparatus to selectively restrain propulsion of said apparatus across said surface while said auger means is transporting said material;

a pulley around which said back-haul cable is reeved;

and means for supporting said pulley in said tank above said tank floor surface to maintain that portion of said back-haul cable connected to said apparatus generally parallel to said tank floor surface.

13. A combination according to claim 12 wherein said means for supporting said pulley comprises a gin-pole extendable through said access opening into said tank and rigidly secured to said tank.

14. A combination according to claim 12 or 13 including an electronic controller and:

wherein said hoist winch means comprises a hydraulic hoist motor controlled by an electrically operable solenoid valve;

wherein said back-haul winch means comprises a hydraulic back-haul motor controlled by an electrically operable solenoid valve;

wherein said auger means comprises a hydraulic auger motor controlled by an electrically operable solenoid valve;

wherein said pump means comprises a hydraulic pump motor controlled by an electrically operable solenoid valve;

wherein said means for steering comprises a hydraulic steering motor controlled by an electrically operable solenoid valve;

and wherein each of said electrically operable solenoid valves is connected to be operated by said electronic controller.

15. In combination:

a liquid storage tank having a rigid floor surface on which a layer of material has accumulated, and having a tank top with an access opening therethrough;

a self-propelled steerable apparatus for removing said material from said surface for disposition elsewhere, said apparatus comprising: a support frame, an auger cooperable with said support frame to define a material transport passage and said auger engageable with said surface, a hydraulically driven motor connected to said auger for rotatingly driving said auger, said auger being operable to transport said material on said surface through said passage for disposition and to propel said apparatus across said surface; a dredge pump for receiving material transported by said auger; a hydraulic motor connected to and for driving said dredge pump; and an elongated swingable steering arm mounted at one end to said frame, and a tail wheel mounted on the other end of said arm for steering said apparatus in a desired path across said surface.

16. The combination of claim 15 including a back-haul winch having a back-haul cable connected to said winch and to said steering arm to selectively restrain propulsion of said apparatus across said surface while said auger is transporting said material.

17. The combination of claim 16 including a pulley around which said back-haul cable is reeved;

and means for supporting said pulley in said tank above said tank floor to maintain that portion of said back-haul cable connected to said apparatus generally parallel to said tank floor.

18. A combination according to claim 17 wherein said means for supporting said pulley comprises a gin-pole extendable through said access opening into said tank and rigidly secured to said tank.

19. A combination according to claim 15 including a hoist winch means having a hoist cable attached to said apparatus for lowering and raising said apparatus through said access opening, and also including an electronic controller and:

wherein said hoist winch means comprises a hydraulic hoist motor controlled by an electrically operable solenoid valve;

wherein said back-haul winch means comprises a hydraulic back-haul motor controlled by an electrically operable solenoid valve;

wherein said auger means comprises a hydraulic auger motor controlled by an electrically operable solenoid valve;

wherein said pump means comprises a hydraulic pump motor controlled by an electrically operable solenoid valve;

wherein said means for steering comprises a hydraulic steering motor controlled by an electrically operable solenoid valve;

and wherein each of said electrically operable solenoid valves is connected to be operated by said electronic controller.

* * * * *